US009854892B2

(12) United States Patent
Moore et al.

(10) Patent No.: US 9,854,892 B2
(45) Date of Patent: Jan. 2, 2018

(54) HAIR STYLING APPLIANCE

(71) Applicant: JEMELLA LIMITED, Leeds (GB)

(72) Inventors: Timothy David Moore, Hertfordshire (GB); Mark Andrew Gagiano, Western Australia (AU)

(73) Assignee: JEMELLA LIMITED, Leeds (GB)

( * ) Notice: Subject to any disclaimer, the term of this patent is extended or adjusted under 35 U.S.C. 154(b) by 505 days.

(21) Appl. No.: 14/398,442

(22) PCT Filed: Apr. 23, 2013

(86) PCT No.: PCT/GB2013/051023
§ 371 (c)(1),
(2) Date: Oct. 31, 2014

(87) PCT Pub. No.: WO2013/164569
PCT Pub. Date: Nov. 7, 2013

(65) Prior Publication Data

US 2015/0122792 A1 May 7, 2015

(30) Foreign Application Priority Data

May 1, 2012 (GB) ..... 1207548.7

(51) Int. Cl.
*A45D 6/20* (2006.01)
*A45D 1/28* (2006.01)
(Continued)

(52) U.S. Cl.
CPC ..... *A45D 1/28* (2013.01); *A45D 1/04* (2013.01); *A45D 2/001* (2013.01);
(Continued)

(58) Field of Classification Search
None
See application file for complete search history.

(56) References Cited

U.S. PATENT DOCUMENTS 1,365,079 A 1/1921 Bardsley
3,182,667 A 5/1965 Den Beste
(Continued)

FOREIGN PATENT DOCUMENTS

DE 202009001872 U1 8/2010
EP 2641501 A1 9/2013
(Continued)

OTHER PUBLICATIONS

UKIPO Examination Report dated Jul. 31, 2014 re: Application No. GB1207549.5; pp. 2.
(Continued)

*Primary Examiner* — Joseph M Pelham
(74) *Attorney, Agent, or Firm* — Cantor Colburn LLP

(57) ABSTRACT

We describe a hair styling apparatus and method of heating a ceramic heater in a hair styling apparatus, the ceramic heater comprising a ceramic layer and a heating element thermally coupled to said ceramic layer, the method comprising: heating the ceramic layer in at least two successive phases, wherein in a first phase the ceramic layer is heated at a first rate of heating to a first temperature; pausing the heating of said ceramic layer at the first temperature; and wherein in a second phase the ceramic layer is heated at a second rate of heating from the first temperature to a second temperature.

22 Claims, 3 Drawing Sheets

(51) Int. Cl.

| | |
|---|---|
| ***A45D 1/04*** | (2006.01) |
| ***A45D 2/00*** | (2006.01) |
| *H05B 1/02* | (2006.01) |
| *H05B 3/26* | (2006.01) |
| *A45D 1/00* | (2006.01) |

(52) U.S. Cl.
CPC ..... *A45D 2001/004* (2013.01); *H05B 1/0252* (2013.01); *H05B 3/265* (2013.01)

(56) References Cited

U.S. PATENT DOCUMENTS

| | | | | |
|---|---|---|---|---|
| 4,739,151 | A | 4/1988 | Smal | |
| 4,968,870 | A | 11/1990 | Moon | |
| 5,223,694 | A | 6/1993 | Tsuji et al. | |
| 5,522,407 | A | 6/1996 | Kelsey | |
| 8,080,764 | B2 | 12/2011 | Shami et al. | |
| 8,232,505 | B2 | 7/2012 | Hottenrott et al. | |
| 2004/0163661 | A1 | 8/2004 | Carlucci | |
| 2005/0252519 | A1 | 11/2005 | Kayser | |
| 2007/0119844 | A1 | 5/2007 | Lo et al. | |
| 2007/0240731 | A1 | 10/2007 | Mukai | |
| 2008/0216860 | A1 | 9/2008 | Legrain | |
| 2009/0044823 | A1* | 2/2009 | Overend | A45D 1/28 132/211 |
| 2009/0084396 | A1* | 4/2009 | Jerome | A45D 1/04 132/224 |
| 2009/0166351 | A1* | 7/2009 | Yokomori | H01L 21/2686 219/492 |
| 2010/0147323 | A1 | 6/2010 | Hafemann | |
| 2010/0170883 | A1 | 7/2010 | Legrain et al. | |
| 2012/0227758 | A1* | 9/2012 | Ford | A45D 1/04 132/211 |
| 2013/0319452 | A1 | 12/2013 | Joo et al. | |
| 2015/0136169 | A1* | 5/2015 | Moore | A45D 1/04 132/225 |
| 2015/0335120 | A1* | 11/2015 | Moore | A45D 1/04 132/211 |

FOREIGN PATENT DOCUMENTS

| | | | |
|---|---|---|---|
| GB | 2082908 | A | 3/1982 |
| GB | 2402876 | A | 12/2004 |
| GB | 2477834 | A | 8/2011 |
| WO | 2009123424 | A1 | 10/2009 |

OTHER PUBLICATIONS

UKIPO Examination Report dated Mar. 21, 2014 re: Application No. GB1207548.7; p. 1; citing: GB2477834 A and GB2402876 A.
UKIPO Search and Examination Report dated Aug. 24, 2012 re: Application No. GB1207549.5; pp. 7; citing: US 2010/0147323 A1, DE 202009001872 U1.
UKIPO Search Report dated Aug. 22, 2012 re: Application No. GB1207548.7; pp. 4; citing: GB 2082908 A and U.S. Pat. No. 4,968,870 A.
International Search Report and Written Opinion dated Jul. 10, 2013 re: Application No. PCT/G2013/051099; citing: US 2010/147323 A1 and WO 2009/2123424.
International Search Report and Written Opinion dated Jul. 16, 2013 re: Application No. PCT/GB2013/051023; citing: GB 2 477 834 A, GB 2 402 876 A, U.S. Pat. No. 4,968,870 A and US 2007/119844 A1.
UK Combined Search and Examination Report dated Aug. 24, 2012 re: Application No. GB1207549.5, pp. 7.
UK Examination Report dated Jul. 31, 2014 re: Application No. GB1207549.5, pp. 2.

* cited by examiner

HAIR STYLING APPLIANCE

FIELD OF THE INVENTION

The invention relates to hair styling apparatus, in particular for straightening hair.

BACKGROUND TO THE INVENTION

There are a variety of apparatus available for styling hair. One form of apparatus is known as a straightener which employs plates that are heatable. To style, hair is clamped between the plates and heated above a transition temperature where it becomes mouldable. Depending on the type, thickness, condition and quantity of hair, the transition temperature may be in the range of 160-200° C.

A hair styling appliance can be employed to straighten, curl and/or crimp hair.

A hair styling appliance for straightening hair is commonly referred to as a "straightening iron" or "hair straightener". FIG. 1 depicts an example of a typical hair straightener 1. The hair straightener 1 includes first and second arms each comprising an arm member 4*a*, 4*b* and heatable plates 6*a*, 6*b* coupled to heaters (not shown) in thermal contact with the heatable plates. The heatable plates are substantially flat and are arranged on the inside surfaces of the arms in an opposing formation. During the straightening process, hair is clamped between the hot heatable plates and then pulled under tension through the plates so as to mould it into a straightened form. The hair straightener may also be used to curl hair by rotating the hair straightener 180° towards the head prior to pulling the hair through the hot heatable plates.

A hair styling appliance for crimping hair is commonly referred to as a "crimping iron". FIG. 2 depicts an example of a typical crimping iron 10). The crimping iron includes first and second arms. Each arm comprises an arm member 14*a*, 14*b* and heatable plates 16*a*, 16*b* coupled to heaters (not shown) in thermal contact with the heatable plates. The heating plates have a saw tooth (corrugated, ribbed) surface and are arranged on the inside surfaces of the arms in an opposing formation. During the crimping process, the hair is clamped between the hot heatable plates until it is moulded into a crimped shape.

Ceramic heaters, in particular those with a pure resistive profile enable optimisation of the thermal control loop, thus allowing the plates in contact with hair to remain near transition temperature during styling and thermal load application. This leads to longevity of style.

Conventional ceramic heaters typically comprise a layered structure having an electrical heater element sandwiched between two layers of ceramic/embedded within the ceramic plate. A heatable plate is then thermally coupled to the heater, on one side of the heater/ceramic sandwich, which provides a contact surface for styling hair.

One problem of heating ceramic used in such heaters is that they can bend as they heat due to differential thermal expansion (sometimes referred to as a 'banana' effect owing to a curving of the plate). Tiny fissures and cracks in the ceramic structures mean that over time, the ceramic may crack, leading to a reduced lifetime of the product. The sandwiching arrangement (with the heater element embedded in the ceramic) goes some way to overcoming this problem, forming a 'balanced heater'. As each ceramic layer is heated by the central heating element, bending under the effect is minimised as the structure is held in a straightened form as the ceramic either side of the heater element oppose one another as they attempt to bend under heating.

However, one downside of this approach is that it requires ceramic heaters to be manufactured with the heater element layer embedded. Furthermore, use of an embedded heater means a surface mount thermistor cannot be used on the heater to measure temperature of the heater accurately—by sitting on the ceramic upper layer, the thermistor would be thermally less well coupled. In addition, provision of more ceramic means the overall thermal mass is increased.

The applicant has recognised a need to improve existing hair styling appliances to address such matters.

SUMMARY OF THE INVENTION

According to a first aspect of the invention there is therefore provided a method of heating a ceramic heater in a hair styling apparatus, the ceramic heater comprising a ceramic layer and a heating element thermally coupled to said ceramic layer, the method comprising: heating said ceramic layer in at least two successive phases, wherein in a first phase said ceramic layer is heated at a first rate of heating to a first temperature; pausing said heating of said ceramic layer at said first temperature; and wherein in a second phase said ceramic layer is heated at a second rate of heating from said first temperature to a second temperature. The second temperature may be the desired operating temperature or may alternatively be an intermediate temperature which is then following by further heating, optionally with further pauses and further heating until the desired operating temperature is reached.

Broadly speaking, embodiments of the invention facilitate heating the appliance very rapidly without substantially compromising the lifetime of the ceramic heater through thermal stresses resulting in cracking and the like. Surprisingly the inventors have determined that it is particularly advantageous to raise the temperature of the ceramic heater in at least two successive phases, preferably with a short pause in between each phase—which has been determined, experimentally, to substantially increase the heater lifetime. In embodiments the heating may be limited to heating in only two successive phases which provides a simple but effective solution to the cracking problem. However in variants, more phases may used. In embodiments the heating is paused for a predetermined interval, preferably less than 5 seconds, 3 seconds, 2 seconds or 1 second. The heating may be stopped at this point by, for example, briefly removing electrical power to the heater. Optionally the distinction between the at least two phases may be determined by ascertaining when the heater, more particularly the heatable plate of the heater, has reached a threshold temperature, although in other approaches the transition from one phase to another may be based upon a time duration. For example the end of the first phase/threshold temperature may be reached in less than 20 seconds, for example 10-20 seconds, more particularly 13-16 seconds. The target/threshold temperature at the end of this first phase may be around 140° C., for example 140° C.+/−20%. In embodiments the final operating temperature of the appliance may be greater than 160° C., for example 185° C.+/−20%.

In a related aspect the invention provides a hair styling appliance comprising a ceramic heater, the ceramic heater comprising a ceramic layer and a heating element coupled to said ceramic layer; a temperature sensor arranged to sense a temperature of said ceramic heater; and a controller configured to control heating of said ceramic heater to an operating temperature, wherein the controller is configured to: control heating of said ceramic layer in at least two successive phases, wherein in a first phase said ceramic layer is heated at a first rate of heating to a first temperature; pause heating of said ceramic layer at said first temperature; and wherein in a second phase said ceramic layer is heated at a second rate of heating from said first temperature to a second temperature.

Although it is preferable to pause the heating between the first and second heating phases, this is not essential.

Thus in a further aspect the invention provides a method of inhibiting cracking a single-sided ceramic heater of a hair styling appliance, the method comprising: providing the hair styling appliance with a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; and controlling electrical power applied to said ceramic heater to heat said heating layer or plate in at least two successive phases; wherein in a first phase a temperature of said heating layer or plate rises towards a knee point temperature and in a second phase a temperature of said heating layer or plate rises above said knee point temperature; and wherein said controlling comprises controlling said electrical power for said ceramic heating to control said temperature of said heating layer or plate to a first target rate of temperature rise during said first phase and controlling said electrical power for said ceramic heating to control said temperature of said heating layer or plate with a second rate of temperature rise during said second phase.

Embodiments of this approach protect the ceramic against cracking by providing two different thermal slew rates, an initial, fast slew rate and a second, slower slew rate. In embodiments the electronic heating control of the appliance controls the slew rate in each of these phases.

Thus in a further space the invention provides a method of inhibiting cracking a single-sided ceramic heater of a hair styling appliance, the method comprising: providing the hair styling appliance with a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; of said ceramic heating; and controlling electrical power applied to said ceramic heating to heat said heating layer or plate in at least two successive phases; wherein in a first phase said controlling controls a rate of temperature rise of said heating layer or plate towards a first slew rate and wherein in a subsequent second phase said controlling controls said rate of temperature rise of said heating layer or plate towards a second, lower slew rate.

The invention also provides a hair styling appliance comprising: a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; and an electric controller to control electrical power applied to said ceramic heating to heat said heating layer or plate in at least two successive phases; wherein in a first phase a temperature of said heating layer or plate rises towards a knee point temperature and in a second phase a temperature of said heating layer or plate rises above said knee point temperature; and wherein said controlling comprises controlling said electrical power for said ceramic heating to control said temperature of said heating layer or plate to a first target rate of temperature rise during said first phase and controlling said electrical power for said ceramic heating to control said temperature of said heating layer or plate with a second rate of temperature rise during said second phase.

The invention further provides a hair styling appliance comprising: a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; and an electrical controller to control electrical power applied to said ceramic heater to heat said heating layer or plate in at least two successive phases; wherein in a first phase said controlling controls a rate of temperature rise of said heating layer or plate towards a first slew rate and wherein in a subsequent second phase said controlling controls said rate of temperature rise of said heating layer or plate towards a second lower slew rate.

As mentioned, preferred embodiments employ a single-sided ceramic heater comprising a heatable heating layer or plate, for example of metal such as aluminium, bearing a layer of ceramic and an electrically conducting heating element. Embodiments of the invention are especially suited to controlling cracking and other stresses related, for example, to non-uniform thermal expansion which can cause mechanical defamation such as bowing (or bananaing) of a ceramic plate, which is particularly problematic in single-sided heater assemblies.

Cracking problems may also be faced with single sided tubular heaters as a temperature differential may still occur across the ceramic leading to the surface in contact with a heater being hotter than the other surface of the ceramic. Ceramics can be sensitive to temperature differences, leading to cracking and crack propagation. Without careful control of the heating, in the worst case, the ceramic tube may even explode. Owing to the fact that, generally speaking, ceramics have poor thermal conductivity compared to metals, a temperature difference, significant enough to lead to cracking, can occur if the system is heated very quickly from room temperature. However, as will be appreciated a user is particularly keen to use an appliance as soon as possible, and so any delay in reaching an operating temperature is undesirable.

The invention further provides a method of heating a ceramic heater in a hair styling apparatus, the method comprising: providing the hair styling appliance with a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; and controlling electrical power applied to said ceramic heater to heat said heating layer or plate in at least two successive phases; wherein in a first phase a temperature of said heating layer or plate rises towards a knee point temperature and in a second phase a temperature of said heating layer or plate rises above said knee point temperature; and wherein said controlling comprises controlling said electrical power for said ceramic heating to control said temperature of said heating layer or plate to a first target rate of temperature rise during said first phase and controlling said electrical power for said ceramic heating to control said temperature of said heating layer or plate with a second rate of temperature rise during said second phase.

In embodiments the heating layer or plate comprises a flat or curved (for example, cylindrical) metal heat transfer element, for example an aluminium heat transfer element.

In embodiments of the above described methods/apparatus preferably the ceramic has a thickness of between 0.2 and 1 mm, for example 0.6 mm+/−20%. If the ceramic layer is too thin, it becomes fragile whilst if it is too thick it is slow to heat.

In embodiments the ceramic heater is substantially planar. In other variants, a substantially tubular ceramic heater may be used with a heating element on either the inner or outer sides.

BRIEF DESCRIPTION OF THE DRAWINGS

For a better understanding of the invention and to show how it may be carried into effect reference shall now be made, by way of example only, to the accompanying drawings in which.

DETAILED DESCRIPTION OF THE PREFERRED EMBODIMENTS

Figure 1:
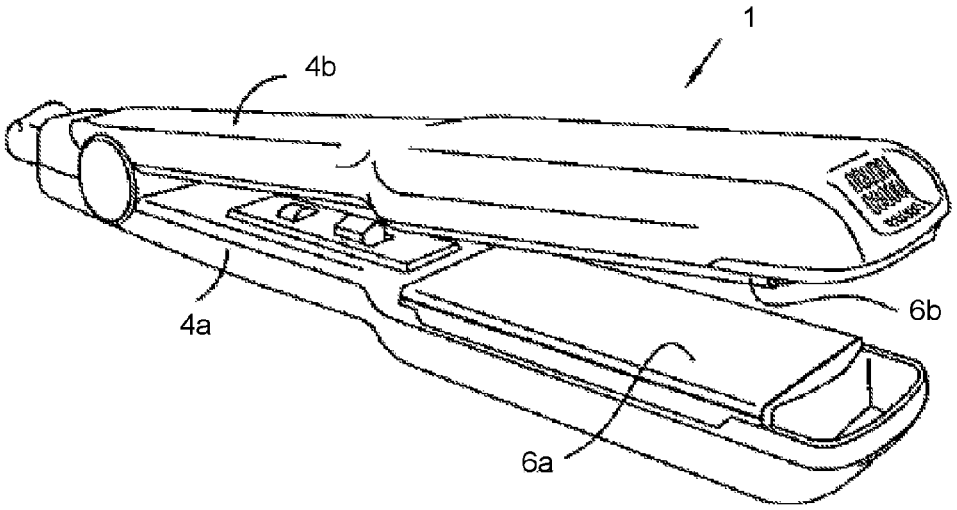
Figure 1 (prior art)
FIG. 1 shows a first example of a hair straightener in a context of which embodiments of the invention may be employed.
Figure 2:
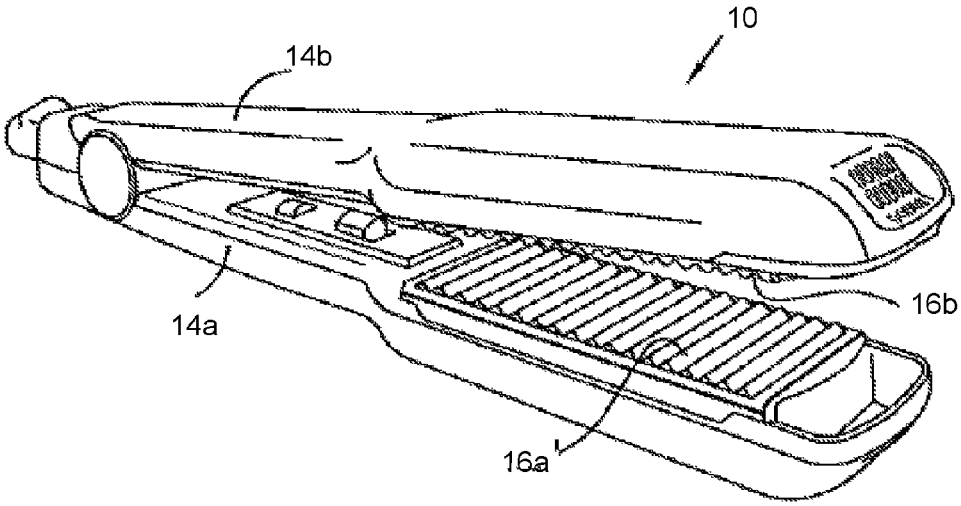
Figure 2 (prior art)
FIG. 2 shows an example of a crimping iron in a context of which embodiments of the invention may be employed.
Figure 3A:
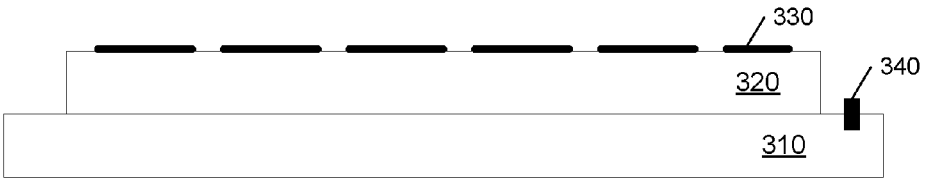
FIG. 3*a* shows, schematically, a vertical cross-section through a heater plate.
Figure 3A:
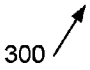

Referring to FIG. 3*a*, this shows a single-sided ceramic heater 300 comprising a metal, for example aluminium, heating plate 310 bearing a layer of ceramic 320, for example an oxide layer, on which is deposited an electrically conductive pattern 330 forming a heating element. The heating plate may incorporate a temperature sensor 340 such as a thermistor or thermocouple; alternatively the temperature sensor may be located elsewhere.

In embodiments the thickness of the metal heating plate 310 may be of order 1-2 mm, and the thickness of the ceramic layer 320 may be of order 0.6 mm.

Figure 3B:
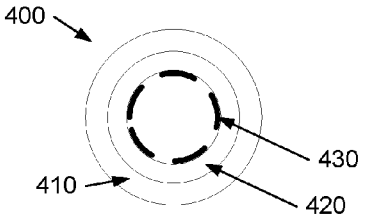
FIG. 3*b* shows, schematically, a cross-section through a tubular heater.
Figure 3C:
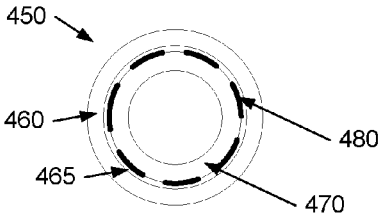
FIG. 3*c* shows, schematically, a cross-section through a variant of the tubular heater of FIG. 3*b;*

In the example of FIG. 3*a*, the heating layers are plates arranged in a planar fashion. In a variant to this, the layers may be formed into a tubular arrangement, in particular tubular plates as shown in FIGS. 3*b* and 3*c*. In FIGS. 3*b* and 3*c* a tubular ceramic heater is used in which the heater is arranged into cylindrical layers with a heating element on one side of the ceramic.

In FIG. 3*b*, the ceramic heater 400 comprises a metal heating layer 410 with an inner ceramic layer 420 with the heating element 430 deposited on the inner side of the ceramic tube.

In FIG. 3*c*, the ceramic heater 450 comprises a metal heating layer 460 with an inner ceramic layer 470 with the heating element 480 deposited on the outer side of the ceramic tube. The heating element 480 is separated from the metal heating layer 460 by an non conductive dielectric 465.

Figure 4:
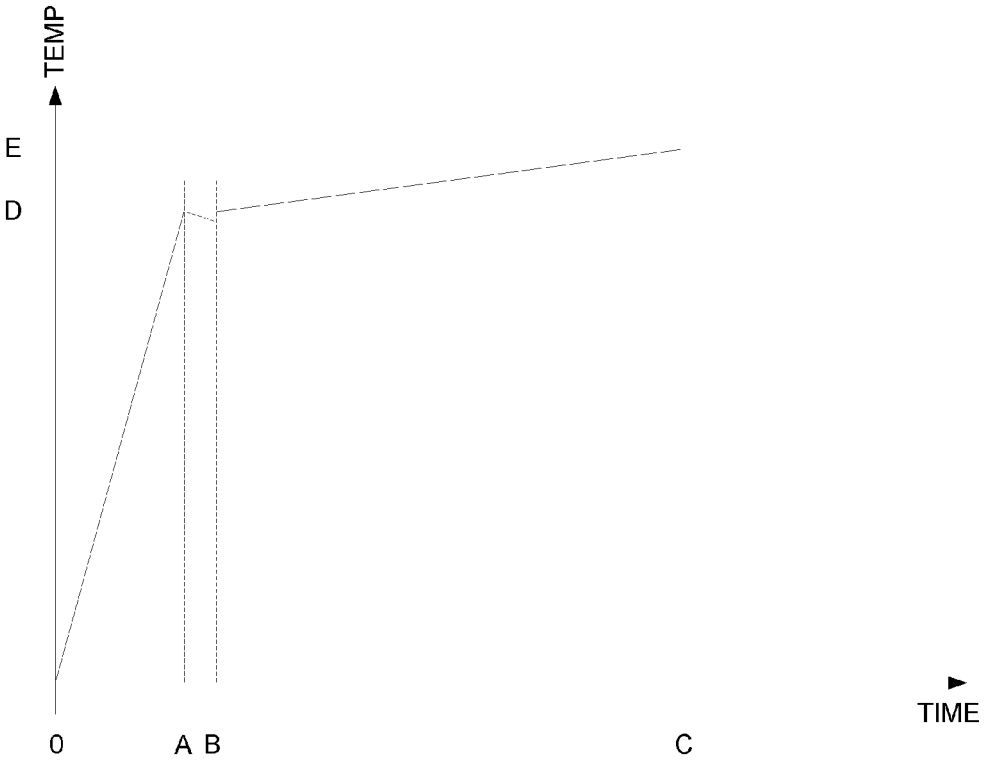
FIG. 4 shows a graph of temperature against time illustrating a method according to an embodiment of the invention.

Referring next to FIG. 4, this shows a graph of temperature against time for the heating plate of FIG. 3*a* according to an embodiment of the invention adopting a two phase heating approach. This graph has a first phase in the region 0-A and a second phase in a region B-C. During the first phase of heating the electronic control system of the hair styling appliance controls the heater to provide a first, fast slew rate, and during the second phase heating is controlled to take place at a second, slower slew rate. The break point between the first and second phases defines a knee on the temperature-time curve. Although schematically illustrated by straight lines the skilled person will appreciate that, in practice, the temperature-time graph may deviate from the idealised illustration.

During the first phase the appliance, more particularly, the heating plate, heats from room temperature to around 140° C. typically over 13-16 seconds. The second slew rate is lower and takes the heater up to a typical operating temperature in the region of 185° C. (temperate E, time C). Preferably there is a short interval, between points A and B in FIG. 4, where heating is temporarily halted (and the temperature may even fall slightly, as indicated by the dotted line). In embodiments this temporary pause may be less than 1 second. Such a pause allows the ceramic heating system to relax. In some embodiments more than one pause may be introduced, provided multiple opportunities for the creaming heating system to relax.

As previously mentioned, a conventional heater has heating plates on both the top and bottom of the ceramic, and this mechanical constraint provides thermal stability. Without a heating plate on top the heater can curl and crack and therefore careful control of the temperature profile of the heating is important. Embodiments of the invention can increase the lifetime of a single-sided ceramic heater vary substantially, for example from thousands of cycles to tens of thousands of cycles, thus providing very substantial benefits in hair styling apparatus comprising one or more single-sided ceramic heating plates.

Figure 5:
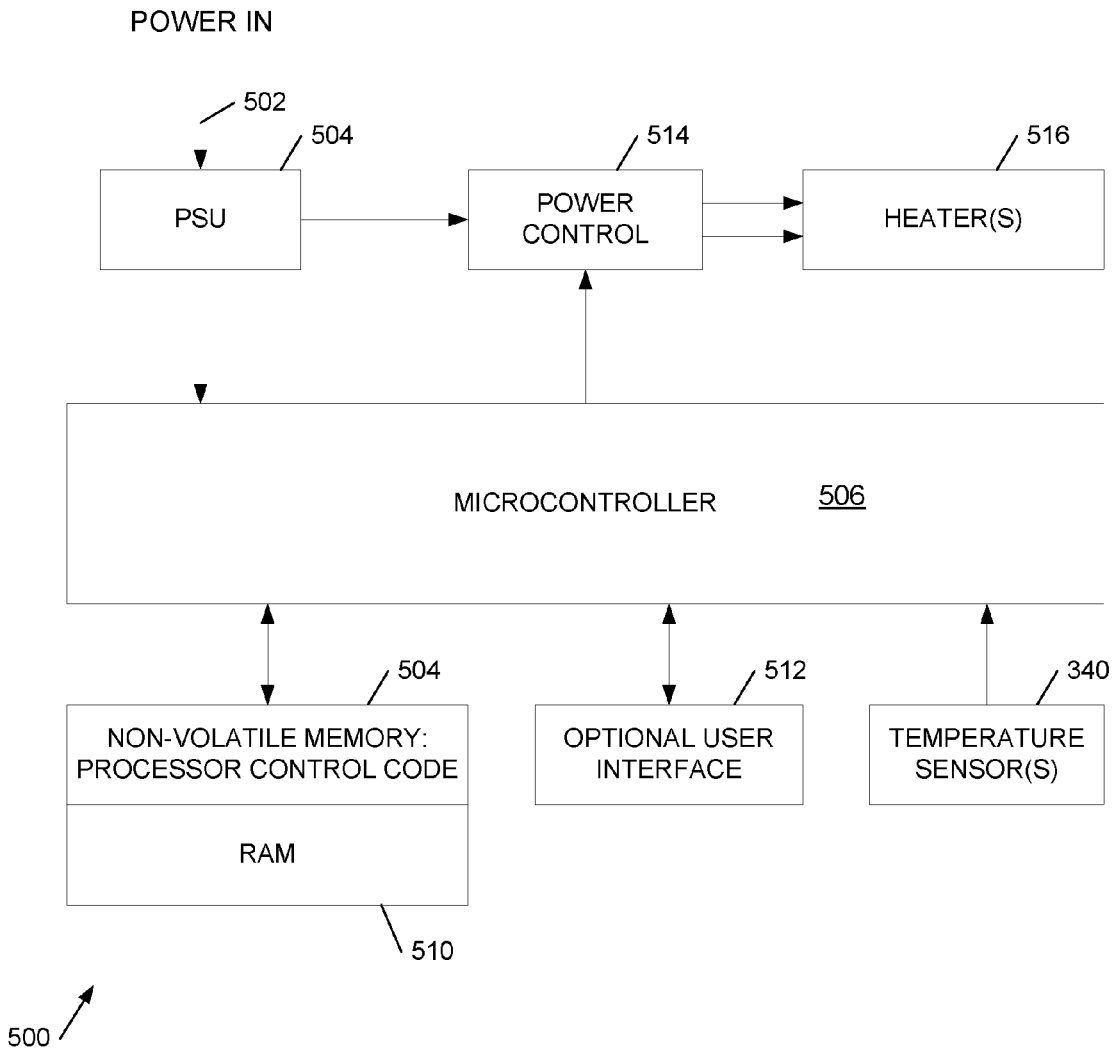
FIG. 5 shows a block diagram of an electronic control system which may be employed, for example, in the hair styling appliances of FIGS. 1 and 2 to implement an embodiment of the invention.

FIG. 5 shows an embodiment of an electronic control system 500 which may be employed to implement the temperature-time control curve of FIG. 4.

The system receives a power input 502 from, for example, a mains power supply, a low voltage power supply (DC or AC), or a battery such as a rechargeable battery. The power input is provided to a power supply unit 504 which provides low voltage DC power to a microcontroller 506 coupled to non-volatile memory 508 storing process of control code for a control algorithm, and to ram 510. An optional user interface 512 is also coupled to microcontroller 506, for example to provide one or more user controls and/or output indications such as a light or audible alert. The latter may be employed to indicate when the temperature of the heating plate has reached either or both of the knee point between the first and second heating phases, and the target operating temperature. The temperature sensor 340 at FIG. 3 also provides an input to microcontroller 506.

The microcontroller provides a control output to one or more power control devices 514, for example power semiconductor switching devices which provide controlled power from input 502 to one or both heaters 516. In embodiments power control module 514 provides pulse width modulation control with a controllable proportion of a mains voltage duty cycle on-time to control the power to heaters 516. This, for example, in the first, high slew rate heating phase, say, a 25% on-time duty cycle may be employed, dropping to a 20% on-time duty cycle during the second heating phase.

The processor control code stored in memory 508 implements a slew rate control procedure, for example by determining a slew rate of the measured temperature, comparing this against the target slew rate and providing an output control signal in response to the difference. The skilled person will appreciate that any of the wide range of different control algorithms may be employed for the control loop including, but not limited to, on-off control, and proportional control. Optionally the control loop may include a feed-forward element responsive to a further input parameter relating to the hair styling apparatus, for example to use the operation of the apparatus, to improve the temperature control.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of heating a ceramic heater in a hair styling apparatus, the ceramic heater comprising a ceramic layer and a heating element thermally coupled to said ceramic layer, the method comprising:

heating said ceramic layer in at least two successive phases, wherein in a first phase said ceramic layer is heated at a first rate of heating to a first temperature;

pausing said heating of said ceramic layer at said first temperature; and wherein in a second phase said ceramic layer is heated at a second rate of heating which is slower than said first rate of heating, from said first temperature to a second temperature.

2. A method as claimed in claim 1, wherein said second temperature is an operating temperature of said ceramic heater.

3. A method as claimed in claim 1, wherein said pausing is for a predetermined period of time of no more than one second.

4. A method as claimed in claim 1, wherein said pausing comprises substantially ceasing to apply electrical power to said ceramic heater.

5. A method as claimed in claim 1, wherein said ceramic has a thickness of between 0.2 mm and 1.0 mm.

6. A method as claimed in claim 1, wherein said first rate of heating achieves said first temperature in a range of thirteen to sixteen seconds.

7. A method as claimed in claim 1, wherein said first temperature is 140° C.±20%.

8. A method as claimed in claim 1, wherein said operating temperature is at least 160° C.

9. A method as claimed in claim 1, wherein said operating temperature is at least 185° C.

10. A method as claimed in claim 1, wherein the ceramic heater is substantially planar.

11. A method as claimed in claim 1, wherein the ceramic heater is substantially tubular.

12. A hair styling appliance comprising a ceramic heater, the ceramic heater comprising a ceramic layer and a heating element coupled to said ceramic layer;

a temperature sensor arranged to sense a temperature of said ceramic heater; and a controller configured to control heating of said ceramic heater, wherein the controller is configured to:

control heating of said ceramic layer in at least two successive phases, wherein in a first phase said ceramic layer is heated at a first rate of heating to a first temperature;

pause heating of said ceramic layer at said first temperature; and wherein in a second phase said ceramic layer is heated at a second rate of heating, slower than said first rate of heating, from said first temperature to a second temperature.

13. A method of inhibiting cracking of a single-sided ceramic heater of a hair styling appliance, the method comprising:

providing the hair styling appliance with a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; and controlling electrical power applied to said ceramic heater to heat said heating layer or plate in at least two successive phases;

wherein in a first phase a temperature of said heating layer or plate rises towards a knee point temperature and in a second phase a temperature of said heating layer or plate rises above said knee point temperature; and wherein said controlling comprises controlling said electrical power for said ceramic heating to control said temperature of said heating layer or plate to a first target rate of temperature rise during said first phase and controlling said electrical power for said ceramic heating to control said temperature of said heating layer or plate with a second rate of temperature rise during said second phase, wherein said second rate of temperature rise is slower than said first rate of temperature rise.

14. A method as claimed in claim 13 wherein said controlling in said second phase comprises:

controlling said electrical power for said ceramic heating to control said temperature of said heating layer or plate to a second target rate of temperature rise during said second phase.

15. A method as claimed in claim 13, wherein said controlling further comprises pausing said heating between said first and second phases.

16. A method of inhibiting cracking a single-sided ceramic heater of a hair styling appliance, the method comprising:

providing the hair styling appliance with a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face of said ceramic heating; and controlling electrical power applied to said ceramic heating to heat said heating layer or plate in at least two successive phases; wherein in a first phase said controlling controls a rate of temperature rise of said heating layer or plate towards a first rate and wherein in a subsequent second phase said controlling controls said rate of temperature rise of said heating layer or plate towards a second, lower rate.

17. A hair styling appliance comprising:

a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; and an electric controller to control electrical power applied to said ceramic heater to heat said heating layer or plate in at least two successive phases; wherein in a first phase a temperature of said heating layer or plate rises towards a knee point temperature and in a second phase a temperature of said heating layer or plate rises above said knee point temperature; and wherein said controlling comprises controlling said electrical power for said ceramic heater to control said temperature of said heating layer or plate to a first target rate of temperature rise during said first phase and controlling said electrical power for said ceramic heater to control said temperature of said heating layer or plate with a second rate of temperature rise during said second phase, wherein said second rate of temperature rise is slower than said first rate of temperature rise.

18. A hair styling appliance as claimed in claim 17, wherein said electronic controller is configured to pause said heating between said first and second phases.

19. A hair styling appliance as claimed in claim 17, wherein said heating layer is directly mounted on said ceramic layer.

20. A hair styling appliance as claimed in claim 17, wherein the ceramic layer is 0.6 mm thick±20%.

21. A hair styling appliance comprising:

a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; and an electrical controller to control electrical power applied to said ceramic heater to heat said heating layer or plate in at least two successive phases;

wherein in a first phase said controlling controls a rate of temperature rise of said heating layer or plate towards a first rate and wherein in a subsequent second phase said controlling controls said rate of temperature rise of said heating layer or plate towards a second lower rate.

22. A method of heating a ceramic heater in a hair styling apparatus, the method comprising:

providing the hair styling appliance with a single-sided ceramic heater, wherein said single-sided ceramic heater has a structure comprising a ceramic layer with an electrical conducting element on a first face of said ceramic layer, a second opposite face of said ceramic layer being mounted on and in thermal contact with a face of a heating layer or plate, wherein said ceramic layer lacks a heating layer or plate on said first face; and controlling electrical power applied to said ceramic heater to heat said heating layer or plate in at least two successive phases;

wherein in a first phase a temperature of said heating layer or plate rises towards a knee point temperature and in a second phase a temperature of said heating layer or plate rises above said knee point temperature; and wherein said controlling comprises controlling said electrical power for said ceramic heater to control said temperature of said heating layer or plate to a first target rate of temperature rise during said first phase and controlling said electrical power for said ceramic heater to control said temperature of said heating layer or plate with a second rate of temperature rise during said second phase, wherein said second rate of temperature rise is slower than said first rate of temperature rise.

* * * * *